US006481399B1

(12) United States Patent
Morrn

(10) Patent No.: US 6,481,399 B1
(45) Date of Patent: Nov. 19, 2002

(54) MECHANICAL REGULATION OF THE STROKE ADJUSTMENT OF AN INTAKE VALVE OF AN INTERNAL-COMBUSTION ENGINE

(75) Inventor: Bernhard Morrn, Siegburg (DE)

(73) Assignee: STS System Technology Services GmbH (DE)

( * ) Notice: Subject to any disclaimer, the term of this patent is extended or adjusted under 35 U.S.C. 154(b) by 0 days.

(21) Appl. No.: 09/695,963

(22) Filed: Oct. 25, 2000

(30) Foreign Application Priority Data

Oct. 29, 1999 (EP) ..... 99121609

(51) Int. Cl.[7] ..... F01L 1/34

(52) U.S. Cl. ..... 123/90.16; 123/90.15; 123/90.26; 123/90.27

(58) Field of Search ..... 123/90.16, 90.15, 123/90.26, 90.27, 90.39, 90.6, 90.61, 347, 348

(56) References Cited

U.S. PATENT DOCUMENTS 4,911,124 A * 3/1990 Bennett ..... 123/347
5,080,054 A * 1/1992 Nakamura ..... 123/90.16
5,452,694 A * 9/1995 Hara ..... 123/90.16
5,622,145 A * 4/1997 Hara ..... 123/90.16
5,682,847 A * 11/1997 Hara ..... 123/90.16
5,692,465 A * 12/1997 Sawada et al. ..... 123/90.16
5,778,839 A * 7/1998 Speil ..... 123/90.16
5,899,180 A * 5/1999 Fischer ..... 123/90.16
5,937,809 A * 8/1999 Pierik et al. ..... 123/90.16
5,992,360 A * 11/1999 Elendt et al. ..... 123/90.16
6,019,076 A * 2/2000 Pierik et al. ..... 123/90.16
6,053,134 A * 4/2000 Linebarger ..... 123/90.16
6,295,958 B2 * 10/2001 Pierik ..... 123/90.16

* cited by examiner

*Primary Examiner*—Teresa Walberg
*Assistant Examiner*—Fadi H. Dahbour
(74) *Attorney, Agent, or Firm*—Perman & Green, LLP

(57) ABSTRACT

The present invention relates to a mechanically regulated valve stroke adjuster. The adjuster has a lifting lever displaying, a means by which the lifting lever is mounted in rotating fashion and in sliding fashion in a guide block, a means which interacts with a camshaft that drives the lifting lever, and a working curve. The adjuster further has at least one means which interacts with the lifting lever and displaces it in the guide block. It also has a camshaft which drives the lifting lever. It still further has a valve which interacts with the working curve of the lifting lever and is moved by it.

18 Claims, 1 Drawing Sheet

MECHANICAL REGULATION OF THE STROKE ADJUSTMENT OF AN INTAKE VALVE OF AN INTERNAL-COMBUSTION ENGINE

BACKGROUND OF THE INVENTION

The present invention relates to a mechanically regulated valve stroke adjuster. The present invention further relates to an internal-combustion engine with a mechanically regulated valve stroke adjuster and a method for regulating the valve strokes in internal-combustion engines.

When switching from full load to part load in internal-combustion engines, a vacuum occurs in the cylinders, as a result of which more fuel than necessary is sucked into the cylinders. This increases the fuel consumption of the internal-combustion engine and unburned fuel may possibly be discharged into the atmosphere.

SUMMARY OF THE INVENTION

The object therefore exists of providing a device with which the fuel consumption of an internal-combustion engine can be reduced.

This object is solved by providing a mechanically regulated valve stroke adjuster having:

A lifting lever displaying
- a means by which the lifting lever is mounted in rotating fashion and in sliding fashion in a guide block,
- a means which interacts with a camshaft that drives the lifting lever, and
- a working curve, At least one means which interacts with the lifting lever and displaces it in the guide block, A camshaft which drives the lifting lever, A valve which interacts with the working curve of the lifting lever and is moved by it.

In another configuration, the valve stroke adjuster according to the invention additionally displays a cam follower with roller which, on the one hand, interacts with the working curve of the lifting lever and is driven by the latter and, on the other hand, interacts with the valve and moves it.

DETAILED DESCRIPTION OF THE INVENTION

Figure 1:
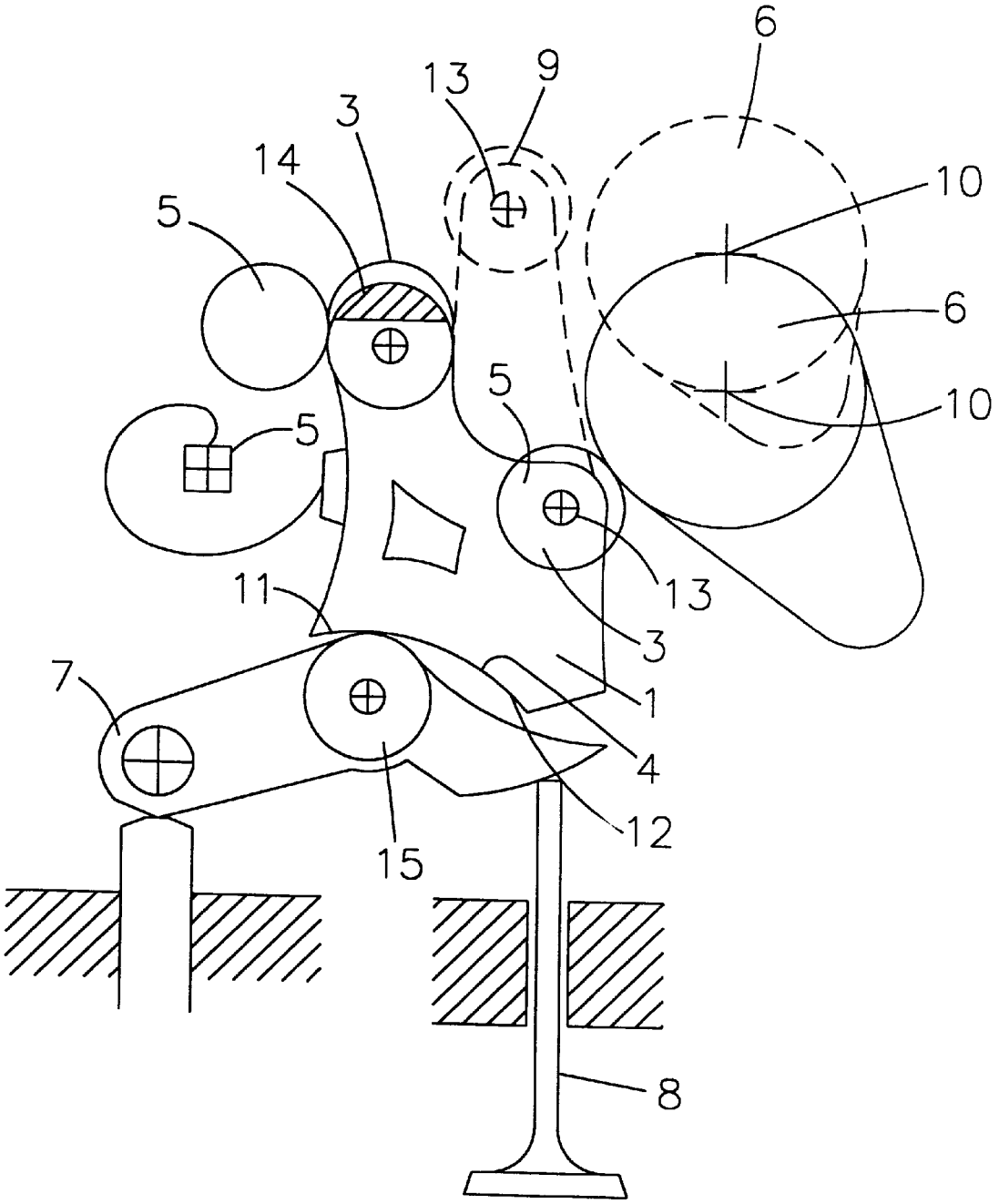
FIG. 1 is a schematic view of a mechanically regulated valve stroke adjuster.

According to the invention, the valve stroke adjuster display a means by which the lifting lever is mounted in rotating fashion and in sliding fashion in a guide block. This means is preferably a roller.

The guide block accommodates the means and thus represents its guide, within which the means and, with it, the lifting lever slides under pressure or traction. The guide block can be of any desired shape selected by a person skilled in the art in such a way that the lifting lever is preferably displaced along a particular straight line and/or curve.

Preferably, however, the guide block has an essentially rectangular form, where the short sides of the rectangle are preferably designed in the shape of a semi-circle. This form of guide block is particularly suitable for accommodating rollers. This guide block can be positioned horizontally or vertically, or at any desired angle to the horizontal or vertical.

Likewise preferably, the guide block has the form of an arc of a circle, the form of which is preferably defined by the geometry of the cam follower with roller, particularly by the roller of the cam follower with roller. This design of the guide block makes it possible, for example, to realise a so-called zero stroke, where the respective valve remains completely closed.

If there are two intake valves per cylinder, the form of, the guide block assigned to the respective valve is preferably different, this making it possible to realise different lifting characteristics per valve.

In a preferred configuration, the valve stroke adjuster according to the invention displays two means which interact with the lifting lever and displace it in the guide block or fix it at a certain position in the guide block for a certain period of time. One means is preferably an eccentric shaft, the other means preferably being a return spring, where the return spring presses the lifting lever against the eccentric shaft and against the camshaft. If there are several eccentric shafts, they can each have a different form, in order to obtain different lifting characteristics per valve.

The person skilled in the art understands that the displacement of the lifting lever in the guide block can also be achieved, for example, by two return springs or by two eccentric shafts, or by any desired pair of means with which opposing forces can be exerted on the lifting lever to fix the lifting lever or displace it within the guide block.

The eccentric shaft is preferably driven by an electric motor, a stepping motor and/or by a worm or toothed-wheel gear. In an advantageous configuration, the centre axis of the means interacting with the camshaft is located on a single horizontal plane with the centre axis of the camshaft.

In another advantageous configuration, the centre axis of the means interacting with the camshaft is located below the centre axis of the camshaft.

The means interacting with the camshaft is preferably a roller.

The valve operating mechanism according to the invention is suitable for valves of any kind. However, the valves are preferably valves of internal-combustion engines, particularly preferably intake valves of internal-combustion engines.

A further object of the invention therefore relates to an internal-combustion engine displaying at least one valve operating mechanism according to the invention.

Preferably at least 4, particularly preferably 6, 8 or 12, valve operating mechanisms according to the invention are present in the internal-combustion engine.

In an internal-combustion engine of this kind, the lifting levers are preferably mounted in rotating fashion on a shaft whose ends are guided in guide blocks located in the cylinder head. In this case, the cylinder head has a special bearing cap.

A further object of the present invention is a method for controlling the stroke of an intake valve of an internal-combustion engine using the valve operating mechanism according to the invention, where the lifting lever is displaced in the guide block in accordance with the power demand on the internal-combustion engine.

When operating at part load, the lifting lever is displaced, and held in this position for a certain period of time, in such a way that the valve or the cam follower with roller is in contact with a part of the working curve of the lifting lever which brings about a reduced valve stroke.

When operating at full load, the lifting lever is displaced, and held in this position for a certain period of time, in such a way that the valve or the cam follower with roller is in contact with a part of the working curve of the lifting lever which achieves the maximum valve stroke.

The present invention has the advantage that the valve stroke can be increased or reduced, depending on the power demand. As a result of the valve stroke adjuster according to the invention, the pumping work in spark-ignition engines is reduced and fuel savings of up to 10% are achieved in comparison with valve operating mechanisms according to the prior art. The mechanical system is far easier, and thus less expensive, to manufacture than electronic systems for controlling the valve stroke, for example. The valve operating mechanism according to the invention is very sturdy and not susceptible to maintenance.

The invention is described below on the basis of FIG. 1. These explanations are merely exemplary and do not restrict the general idea of the invention.

FIG. 1 shows the valve operating mechanism according to the invention. Lifting lever 1 is mounted with roller 2 in guide block 3 (only partially shown) in sliding fashion. The person skilled in the art recognises that the roller can also be a shaft, on which each lifting lever is mounted in rotating fashion. The lifting lever is displaced in the guide block by eccentric shaft 5 and return spring 5. The direction in which the lifting lever is displaced in the guide block is illustrated by line 14. The person skilled in the art understands that the two means 5 are also capable of holding lifting lever 1 in a certain position within the guide block. The eccentric shaft is driven by a stepping motor (not shown).

Furthermore, lifting lever 1 has another roller 9, which interacts with camshaft 6 and drives lifting lever 1.

The lower area of lifting lever 1 displays a working curve 4, which has approximately the form of a parabola. This working curve is in contact with roller 15, which is mounted on cam follower with roller 7. For its part, cam follower with roller 7 moves valve 8.

Depending on the available space, centre axis 13 of roller 9 is located below centre axis 10 of camshaft 6 or, as indicated by the broken line, centre axis 13 of roller 9 is located in the same horizontal plane as centre axis 10 of camshaft 6.

If, for example, an internal-combustion engine is operated at part load, lifting lever 1 is displaced in guide block 3 in such a way that cam follower with roller 7 interacts with left-hand part 11 of working curve 4, with the result that the stroke of valve 8 is reduced. At full load, in contrast, lifting lever 1 is displaced in guide block 3 in such a way that right-hand part 12 of working curve 4 is in contact with cam follower with roller 7, the result being that the stroke of valve 8 is at its maximum.

What is claimed is:

1. Mechanically regulated valve stroke adjuster having:

a lifting lever (1) displaying a means (2) by which the lifting lever (1) is mounted in rotating fashion and in sliding fashion in a guide block (3), a means (9) which interacts with a camshaft (6) that drives the lifting lever (1), and a working curve (4), at least one means (5) which interacts with the lifting lever (1) and displaces it in the guide block, a camshaft (6) which interacts with the means (9) of the lifting lever (1) and drives it, a valve (8) which interacts with the working curve (4) of the lifting lever (1) and is moved by it.

2. Valve stroke adjuster as per claim 1, comprising two means (5), where one means is an eccentric shaft and the other means is a return spring.

3. Valve stroke adjuster as per claim 2, wherein the eccentric shaft is driven by an electric motor, stepping motor or a worm or toothed-wheel gear.

4. Mechanically regulated valve stroke adjuster having:

a lifting lever (1) displaying a means (2) by which the lifting lever (1) is mounted in rotating fashion and in sliding fashion in a guide block (3), a means (9) which interacts with a camshaft (6) that drives the lifting lever (1), and a working curve (4), at least one means (5) which interacts with the lifting lever (1) and displaces it in the guide block, a camshaft (6) which interacts with the means (9) of the lifting lever (1) and drives it, a valve (8) which interacts with the working curve (4) of the lifting lever (1) and is moved by it, and wherein the center axis (13) of the means (9) is located on the same horizontal plane as the center axis (10) of the camshaft (6).

5. Valve operating mechanism as per one of claims 1, wherein the center axis (13) of the means (9) is located below the center axis (10) of the camshaft (6).

6. Valve operating mechanism as per one of claims 1, wherein the means (2) and/or the means (9) is a roller.

7. Valve operating mechanism as per one of claims 1, wherein the valve is an intake valve of an internal-combustion engine.

8. Internal-combustion engine, comprising at least 4, 6, 8 or 12, valve operating mechanisms according to claim 1.

9. Method for controlling the stroke of an intake valve of an internal-combustion engine using a valve operating mechanism comprising providing:

a lifting lever (1) displaying a means (2) by which the lifting lever (1) is mounted in rotating fashion and in sliding fashion in a guide block (3), a means (9) which interacts with a camshaft (6) that drives the lifting lever (1), and a working curve (4), at least one means (5) which interacts with the lifting lever (1) and displaces it in the guide block, a camshaft (6) which interacts with the means (9) of the lifting lever (1) and drives it, a valve (8) which interacts with the working curve (4) of the lifting lever (1) and is moved by it, and displacing the lifting lever (1) in the guide block (3) in accordance with the power demand on the internal-combustion engine.

10. Method as per claim 9, wherein, when operating at part load of the internal-combustion engine, the lifting lever (1) is displaced in such a way that a left-hand part (11) of the working curve (4) interacts with the valve or a cam follower with roller (7).

11. Method as per claim 9, wherein, when operating at full load of the internal-combustion engine, the lifting lever (1) is displaced in such a way that a right-hand part (12) of the working curve (4) interacts with the valve or a cam follower with roller (7).

12. Valve stroke adjuster as per claim 1, wherein the working curve (4) is arranged at a bottom end of the lifting lever (1).

13. Mechanically regulated valve stroke adjuster having a lifting lever (1) displaying a means (2) by which the lifting lever (1) is mounted in rotating fashion and in sliding fashion in a guide block (3), a means (9) which interacts with a camshaft (6) that drives the lifting lever (1), and a working curve (4), at least one means (5) which interacts with the lifting lever (1) and displaces it in the guide block, a camshaft (6) which interacts with the means (9) of the lifting lever (1) and drives it purely rotationally, a cam follower with roller (7) which interacts with the working curve (4) of the lifting lever (1) and is driven by the latter, a valve (8) which interacts with the cam follower with roller (7) and is moved by it.

14. Mechanically regulated valve stroke adjuster having:

a lifting lever (1) displaying a means (2) by which the lifting lever (1) is mounted in rotating fashion and in sliding fashion in a guide block (3), a means (9) which interacts with a camshaft (6) that drives the lifting lever (1), and a working curve (4), at least one means (5) which interacts with the lifting lever (1) and displaces it in the guide block, a camshaft (6) which interacts with the means (9) of the lifting lever (1) and drives it, a cam follower with roller (7) which interacts with the working curve (4) of the lifting lever (1) and is driven by the latter, valve (8) which interacts with the cam follower with roller (7) and is moved by it, and wherein the center axis (13) of the means (9) is located on the same horizontal plane as the center axis (10) of the camshaft (6).

15. Valve stroke adjuster as per claim 14, wherein the working curve (4) is arranged at a bottom end of the lifting lever (1).

16. Method for controlling the stroke of an intake valve of an internal-combustion engine using a valve operating mechanism comprising providing:

a lifting lever (1) displaying a means (2) by which the lifting lever (1) is mounted in rotating fashion and in sliding fashion in a guide block (3), a means (9) which interacts with a camshaft (6) that drives the lifting lever (1), and a working curve (4), at least one means (5) which interacts with the lifting lever (1) and displaces it in the guide block, a camshaft (6) which interacts with the means (9) of the lifting lever (1) and drives it, a cam follower with roller (7) which interacts with the working curve (4) of the lifting lever (1) and is driven by the latter, a valve (8) which interacts with the cam follower with roller (7) and is moved by it, and displacing the lifting lever (1) in the guide block (3) in accordance with the power demand on the internal-combustion engine.

17. Method as per claim 16, wherein, when operating at part load of the internal-combustion engine, the lifting lever (1) is displaced in such a way that a left-hand part (11) of the working curve (4) interacts with the valve or the cam follower with roller (7).

18. Method as per claim 16, wherein, when operating at full load of the internal-combustion engine, the lifting lever (1) is displaced in such a way that a right-hand part (12) of the working curve (4) interacts with the valve or the cam follower with roller (7).

* * * * *